US006045630A

United States Patent [19]

Fujiwara et al.

[11] Patent Number: 6,045,630

[45] Date of Patent: Apr. 4, 2000

[54] HIGH-TOUGHNESS, HIGH-TENSILE-STRENGTH STEEL AND METHOD OF MANUFACTURING THE SAME

[75] Inventors: Kazuki Fujiwara, Nishinomiya; Shuji Okaguchi, Yao; Masahiko Hamada, Amagasaki; Yu-ichi Komizo, Nishinomiya, all of Japan

[73] Assignee: Sumitomo Metal Industries, Ltd., Osaka, Japan

[21] Appl. No.: 09/028,574

[22] Filed: Feb. 24, 1998

[30] Foreign Application Priority Data

Feb. 25, 1997 [JP] Japan ..... 9-40839

[51] Int. Cl.[7] ..... C22C 38/04; C22C 38/08; C22C 38/48; C21D 8/00

[52] U.S. Cl. ..... 148/336; 148/654

[58] Field of Search ..... 148/336, 654; 420/126, 127, 128

[56] References Cited

U.S. PATENT DOCUMENTS 5,876,521 3/1999 Koo et al. ..... 148/336

FOREIGN PATENT DOCUMENTS 149814 7/1987 Japan ..... 148/336
8-104922 4/1996 Japan .
8-209287 8/1996 Japan .
8-209288 8/1996 Japan .
8-209290 8/1996 Japan .
8-209291 8/1996 Japan .

*Primary Examiner*—Deborah Yee
*Attorney, Agent, or Firm*—Burns, Doane, Swecker & Mathis, LLP

[57] ABSTRACT

High-tensile-strength steel having excellent arrestability and a TS of not less than 900 MPa, as well as a method of manufacturing the same. The steel of the invention has the following composition (% by weight): C: 0.02% to 0.1%; Si: not greater than 0.6%; Mn: 0.2% to 2.5%; Ni: greater than 1.2% but not greater than 2.5%; Nb: 0.01% to 0.1%; Ti: 0.005% to 0.03%; N: 0.001% to 0.006%; Al: not greater than 0.1%; and optional elements. Ceq of the B-free steel is 0.53–0.7%, and Ceq of the B-bearing steel is 0.4–0.58%. The microstructure of the steel may be a mixed structure of martensite (M) and lower bainite (LB) occupying at least 90 vol. % in the microstructure, LB occupying at least 2 vol. % in the mixed structure, and the aspect ratio of prior austenite grains is not less than 3.

13 Claims, 5 Drawing Sheets

| | Test No. | Steel No. | Base steel: Tensile test YS (MPa) | Base steel: Tensile test TS (MPa) | Base steel: Charpy test vE-40 (J) | Base steel: DWTT 85%FATT (℃) | Welded joint: Tensile test TS (MPa) | Welded joint: Charpy test vE-20 (J) | Field weldability: y-groove crack test (no preheat) |
|---|---|---|---|---|---|---|---|---|---|
| Examples of this invention | 1 | 1 | 881 | 966 | 263 | -54 | 927 | 213 | No crack |
| | 2 | 2 | 881 | 964 | 263 | -56 | 979 | 156 | No crack |
| | 3 | 3 | 881 | 964 | 263 | -52 | 944 | 214 | No crack |
| | 4 | 4 | 862 | 941 | 276 | -56 | 929 | 224 | No crack |
| | 5 | 5 | 920 | 1008 | 236 | -55 | 937 | 198 | No crack |
| | 6 | 6 | 909 | 996 | 244 | -51 | 984 | 190 | No crack |
| | 7 | 7 | 930 | 1030 | 238 | -52 | 975 | 188 | No crack |
| | 8 | 8 | 954 | 1058 | 221 | -54 | 991 | 187 | No crack |
| | 9 | 9 | 923 | 1022 | 242 | -56 | 983 | 216 | No crack |
| | 10 | 10 | 880 | 973 | 222 | -53 | 952 | 188 | No crack |
| | 11 | 11 | 897 | 991 | 211 | -52 | 987 | 183 | No crack |
| | 12 | 12 | 879 | 970 | 224 | -58 | 972 | 212 | No crack |
| Examples for comparing | X1 | *X1 | 913 | 1001 | * 81 | *-22 | 905 | * 82 | No crack |
| | X2 | *X2 | 881 | 964 | * 93 | *-24 | *887 | * 79 | No crack |
| | X3 | *X3 | 872 | 963 | * 88 | *-26 | 910 | * 80 | No crack |
| | X4 | *X4 | 912 | 999 | * 42 | *-26 | 905 | 179 | No crack |
| | X5 | *X5 | 892 | 976 | * 95 | *-20 | *846 | * 88 | No crack |
| | X6 | *X6 | 886 | 979 | * 88 | *-23 | 914 | * 87 | No crack |
| | X7 | *X7 | 925 | 1014 | * 83 | *-21 | 908 | * 92 | No crack |
| | X8 | *X8 | 950 | 1044 | * 65 | *-23 | 915 | 180 | No crack |
| | X9 | *X9 | 971 | 1068 | * 51 | *-20 | 920 | * 71 | *Crack |
| | X10 | *X10 | 798 | *823 | 151 | -42 | 902 | * 70 | No crack |
| | X11 | *X11 | 1003 | 1115 | * 37 | *-18 | 944 | * 82 | *Crack |
| | X12 | *X12 | 731 | *813 | 156 | -54 | 900 | 189 | No crack |
| | Y1 | 1 | 586 | *724 | * 44 | *-16 | 924 | 216 | No crack |
| | Y2 | 3 | 876 | 958 | * 21 | *-18 | 941 | 224 | No crack |
| | Y6 | 6 | 576 | *738 | * 46 | *-22 | 977 | 196 | No crack |
| | Y10 | 10 | 682 | *796 | *112 | *-24 | 954 | 201 | No crack |

Mark * attached steel No. indicates it is out of the range and one attached to a test result shows it does not attain the aimed level.

Fig. 1

| | Steel No. | Chemical composition (1) (mass%) | | | | | | | | | Ceq |
|---|---|---|---|---|---|---|---|---|---|---|---|
| | | C | Si | Mn | Ni | Nb | Ti | B | Al | N | |
| Examples of this invention | 1 | 0.080 | 0.31 | 1.80 | 1.31 | 0.03 | 0.012 | 0.001 | 0.042 | 0.0021 | 0.554 |
| | 2 | 0.081 | 0.32 | 1.46 | 1.31 | 0.02 | 0.012 | 0.001 | 0.025 | 0.0027 | 0.499 |
| | 3 | 0.088 | 0.32 | 1.45 | 1.29 | 0.03 | 0.012 | 0.001 | 0.021 | 0.0019 | 0.499 |
| | 4 | 0.077 | 0.09 | 1.81 | 1.22 | 0.05 | 0.012 | 0.001 | 0.041 | 0.0046 | 0.468 |
| | 5 | 0.082 | 0.33 | 1.22 | 1.23 | 0.05 | 0.012 | 0.001 | 0.084 | 0.0023 | 0.539 |
| | 6 | 0.080 | 0.45 | 1.20 | 1.29 | 0.02 | 0.012 | 0.001 | 0.051 | 0.0044 | 0.526 |
| | 7 | 0.081 | 0.06 | 1.52 | 1.79 | 0.02 | 0.012 | — | 0.044 | 0.0032 | 0.624 |
| | 8 | 0.079 | 0.31 | 1.54 | 2.30 | 0.02 | 0.012 | — | 0.025 | 0.0018 | 0.654 |
| | 9 | 0.071 | 0.22 | 2.21 | 1.79 | 0.02 | 0.012 | — | 0.015 | 0.0033 | 0.642 |
| | 10 | 0.072 | 0.35 | 1.45 | 1.32 | 0.02 | 0.012 | — | 0.071 | 0.0032 | 0.563 |
| | 11 | 0.051 | 0.44 | 1.54 | 1.32 | 0.02 | 0.012 | 0.001 | 0.031 | 0.0042 | 0.570 |
| | 12 | 0.081 | 0.12 | 1.58 | 1.71 | 0.03 | 0.012 | — | 0.025 | 0.0034 | 0.561 |
| Examples for comparing | X1 | *0.12 | 0.31 | 1.46 | 1.31 | 0.03 | 0.012 | 0.001 | 0.044 | 0.0046 | 0.524 |
| | X2 | 0.081 | *0.88 | 1.46 | 1.31 | 0.02 | 0.012 | 0.001 | 0.022 | 0.0044 | 0.499 |
| | X3 | 0.088 | 0.22 | *2.72 | 1.29 | 0.03 | 0.012 | — | 0.051 | 0.0045 | 0.613 |
| | X4 | 0.077 | 0.09 | 1.20 | 1.32 | 0.05 | 0.012 | 0.001 | 0.042 | 0.0045 | 0.536 |
| | X5 | 0.082 | 0.33 | 2.22 | *0.63 | 0.05 | 0.012 | 0.001 | 0.018 | 0.0043 | 0.572 |
| | X6 | 0.080 | 0.45 | 0.86 | 2.29 | 0.02 | 0.012 | — | 0.053 | 0.0041 | 0.638 |
| | X7 | 0.081 | 0.06 | 1.21 | 1.31 | 0.02 | 0.012 | 0.001 | 0.048 | 0.0044 | 0.545 |
| | X8 | 0.079 | 0.31 | 1.19 | 1.74 | 0.02 | 0.012 | 0.001 | 0.056 | 0.0047 | 0.576 |
| | X9 | 0.082 | 0.35 | 1.45 | 1.74 | 0.02 | *0.132 | 0.001 | 0.063 | 0.0044 | *0.601 |
| | X10 | 0.062 | 0.21 | 1.22 | 1.32 | 0.02 | 0.012 | 0.001 | *0.122 | 0.0041 | 0.507 |
| | X11 | 0.081 | 0.12 | 1.59 | 1.52 | 0.03 | 0.012 | — | 0.042 | 0.0041 | *0.709 |
| | X12 | 0.081 | 0.12 | 1.41 | 1.32 | 0.03 | 0.012 | — | 0.051 | 0.0042 | *0.499 |

Mark * attached to a numerical value indicates it is out of the range defined as this invention.

Fig. 2

| | Steel No. | Chemical composition (2) (bal. Fe : mass%) | | | | | | | Vs |
|---|---|---|---|---|---|---|---|---|---|
| | | Cu | Cr | Mo | V | Ca | P | S | |
| Examples of this invention | 1 | — | — | 0.51 | — | — | 0.011 | 0.001 | 0.330 |
| | 2 | — | — | 0.51 | — | — | 0.009 | 0.002 | 0.253 |
| | 3 | — | — | 0.49 | — | — | 0.012 | 0.001 | 0.276 |
| | 4 | 0.23 | 0.42 | 0.12 | 0.04 | 0.003 | 0.013 | 0.002 | 0.397 |
| | 5 | 0.31 | 0.31 | 0.47 | 0.05 | | 0.011 | 0.001 | 0.258 |
| | 6 | 0.31 | 0.28 | 0.46 | 0.03 | — | 0.011 | 0.002 | 0.246 |
| | 7 | 0.32 | 0.28 | 0.51 | 0.03 | 0.003 | 0.011 | 0.001 | 0.259 |
| | 8 | 0.33 | 0.29 | 0.47 | 0.03 | 0.004 | 0.008 | 0.001 | 0.199 |
| | 9 | 0.28 | — | 0.38 | 0.03 | — | 0.007 | 0.001 | 0.372 |
| | 10 | 0.31 | 0.31 | 0.44 | 0.03 | — | 0.011 | 0.001 | 0.287 |
| | 11 | 0.21 | 0.31 | 0.45 | 0.04 | — | 0.003 | 0.001 | 0.292 |
| | 12 | 0.54 | — | 0.41 | — | 0.002 | 0.012 | 0.001 | 0.312 |
| Examples for comparing | X1 | — | — | 0.51 | — | — | 0.013 | 0.002 | 0.312 |
| | X2 | — | — | 0.51 | — | — | 0.012 | 0.001 | 0.268 |
| | X3 | — | — | — | — | 0.003 | 0.013 | 0.001 | 0.568 |
| | X4 | *1.15 | 0.42 | 0.12 | 0.04 | — | 0.008 | 0.002 | 0.332 |
| | X5 | 0.31 | 0.31 | — | 0.05 | — | 0.007 | 0.002 | 0.529 |
| | X6 | — | *0.89 | 0.46 | 0.03 | 0.004 | 0.008 | 0.001 | 0.032 |
| | X7 | — | 0.28 | *0.64 | 0.03 | 0.003 | 0.009 | 0.001 | 0.194 |
| | X8 | 0.33 | 0.29 | 0.47 | *0.12 | — | 0.010 | 0.001 | 0.195 |
| | X9 | 0.31 | 0.31 | 0.44 | 0.03 | — | 0.009 | 0.002 | 0.244 |
| | X10 | 0.21 | 0.31 | 0.45 | 0.04 | — | 0.011 | 0.002 | 0.220 |
| | X11 | 0.59 | 0.48 | 0.62 | 0.01 | 0.003 | 0.013 | 0.002 | 0.330 |
| | X12 | 0.21 | 0.21 | 0.25 | 0.01 | — | 0.012 | 0.002 | 0.295 |

Mark * attached to a numerical value indicates it is out of the range defined as this invention.

Fig. 3

| | Test No. | Steel No. | Plate thick-ness (mm) | Rolling heat temp. (℃) | Rolling cumulative reduction ratio (%) | Rolling finish temp. (℃) | Cooling cooling rate (℃/s) | Cooling stop temp. (℃) |
|---|---|---|---|---|---|---|---|---|
| Examples of this invention | 1 | 1 | 25 | 1100 | 66 | 800 | 14 | 180 |
| | 2 | 2 | 25 | 1150 | 66 | 780 | 21 | 440 |
| | 3 | 3 | 18 | 1150 | 75 | 780 | 22 | 250 |
| | 4 | 4 | 18 | 1100 | 75 | 820 | 21 | **RT |
| | 5 | 5 | 32 | 1100 | 55 | 800 | 16 | 400 |
| | 6 | 6 | 25 | 1100 | 66 | 780 | 21 | 420 |
| | 7 | 7 | 18 | 1150 | 75 | 800 | 22 | 340 |
| | 8 | 8 | 25 | 1100 | 55 | 780 | 16 | 150 |
| | 9 | 9 | 25 | 1150 | 66 | 800 | 22 | **RT |
| | 10 | 10 | 18 | 1100 | 75 | 780 | 22 | 440 |
| | 11 | 11 | 25 | 1100 | 66 | 780 | 21 | 420 |
| | 12 | 12 | 18 | 1150 | 75 | 800 | 22 | 150 |
| Examples for comparing | X1 | *X1 | 25 | 1100 | 66 | 780 | 21 | 440 |
| | X2 | *X2 | 25 | 1150 | 66 | 800 | 20 | 480 |
| | X3 | *X3 | 25 | 1050 | 75 | 780 | 22 | 340 |
| | X4 | *X4 | 25 | 1100 | 66 | 800 | 21 | **RT |
| | X5 | *X5 | 25 | 1150 | 75 | 820 | 20 | 400 |
| | X6 | *X6 | 25 | 1100 | 66 | 780 | 22 | 340 |
| | X7 | *X7 | 18 | 1150 | 75 | 800 | 19 | 440 |
| | X8 | *X8 | 25 | 1100 | 66 | 820 | 16 | 400 |
| | X9 | *X9 | 18 | 1100 | 75 | 820 | 22 | 380 |
| | X10 | *X10 | 25 | 1150 | 66 | 780 | 21 | 440 |
| | X11 | *X11 | 18 | 1100 | 75 | 780 | 22 | 280 |
| | X12 | *X12 | 25 | 1100 | 66 | 800 | 19 | 440 |
| | Y1 | 1 | 25 | *870 | 66 | 780 | 16 | 440 |
| | Y2 | 3 | 32 | 1100 | *25 | 800 | 22 | 380 |
| | Y3 | 6 | 18 | 1050 | 75 | 820 | * 6 | 420 |
| | Y10 | 10 | 25 | 1100 | 66 | 780 | * 3 | * — |

1) Mark * attached to steel No. or TMCP condition indicates it is out of range defined as this invention.

2) **RT represents room temperature.

Table 4

| | Test No. | Steel No. | Microstructure | | |
|---|---|---|---|---|---|
| | | | M+LB (vol%) | LB (vol%) | Aspect ratio |
| Examples of this invention | 1 | 1 | 95 | 8 | 3.4 |
| | 2 | 2 | 96 | 8 | 3.6 |
| | 3 | 3 | 94 | 7 | 3.4 |
| | 4 | 4 | 92 | 7 | 3.6 |
| | 5 | 5 | 97 | 8 | 3.7 |
| | 6 | 6 | 96 | 8 | 3.7 |
| | 7 | 7 | 98 | 7 | 3.4 |
| | 8 | 8 | 98 | 8 | 3.6 |
| | 9 | 9 | 97 | 8 | 4.6 |
| | 10 | 10 | 95 | 8 | 3.6 |
| | 11 | 11 | 96 | 9 | 3.6 |
| | 12 | 12 | 94 | 7 | 3.8 |
| Examples for comparing | X1 | X1 | 97 | 8 | 3.4 |
| | X2 | X2 | 95 | 7 | 3.7 |
| | X3 | X3 | 94 | 6 | 3.8 |
| | X4 | X4 | 94 | 6 | *2.4 |
| | x5 | x5 | 94 | 5 | 3.4 |
| | X6 | X6 | 95 | 5 | 3.7 |
| | X7 | X7 | 98 | 5 | 3.6 |
| | X8 | X8 | 98 | 5 | 3.4 |
| | X9 | X9 | 100 | * 0 | 3.6 |
| | X10 | X10 | *87 | *15 | 3.5 |
| | X11 | X11 | 93 | 7 | 3.7 |
| | X12 | X12 | *82 | *22 | 3.8 |
| | Y1 | 1 | *61 | *42 | 3.2 |
| | Y3 | 3 | 96 | 8 | *1.2 |
| | Y6 | 6 | *66 | *54 | 3.7 |
| | Y10 | 10 | *32 | *11 | 3.4 |

Mark * attached to a steel no. and a numerical value indicates it is out of the range defined as this invention.

Fig. 5

| | Test No. | Steel No. | Base steel: Tensile test YS (MPa) | Base steel: Tensile test TS (MPa) | Base steel: Charpy test vE-40 (J) | Base steel: DWTT 85%FATT (℃) | Welded joint: Tensile test TS (MPa) | Welded joint: Charpy test vE-20 (J) | Field weldability: y-groove crack test (no preheat) |
|---|---|---|---|---|---|---|---|---|---|
| Examples of this invention | 1 | 1 | 881 | 966 | 263 | -54 | 927 | 213 | No crack |
| | 2 | 2 | 881 | 964 | 263 | -56 | 979 | 156 | No crack |
| | 3 | 3 | 881 | 964 | 263 | -52 | 944 | 214 | No crack |
| | 4 | 4 | 862 | 941 | 276 | -56 | 929 | 224 | No crack |
| | 5 | 5 | 920 | 1008 | 236 | -55 | 937 | 198 | No crack |
| | 6 | 6 | 909 | 996 | 244 | -51 | 984 | 190 | No crack |
| | 7 | 7 | 930 | 1030 | 238 | -52 | 975 | 188 | No crack |
| | 8 | 8 | 954 | 1058 | 221 | -54 | 991 | 187 | No crack |
| | 9 | 9 | 923 | 1022 | 242 | -56 | 983 | 216 | No crack |
| | 10 | 10 | 880 | 973 | 222 | -53 | 952 | 188 | No crack |
| | 11 | 11 | 897 | 991 | 211 | -52 | 987 | 183 | No crack |
| | 12 | 12 | 879 | 970 | 224 | -58 | 972 | 212 | No crack |
| Examples for comparing | X1 | *X1 | 913 | 1001 | * 81 | *-22 | 905 | * 82 | No crack |
| | X2 | *X2 | 881 | 964 | * 93 | *-24 | *887 | * 79 | No crack |
| | X3 | *X3 | 872 | 963 | * 88 | *-26 | 910 | * 80 | No crack |
| | X4 | *X4 | 912 | 999 | * 42 | *-26 | 905 | 179 | No crack |
| | X5 | *X5 | 892 | 976 | * 95 | *-20 | *846 | * 88 | No crack |
| | X6 | *X6 | 886 | 979 | * 88 | *-23 | 914 | * 87 | No crack |
| | X7 | *X7 | 925 | 1014 | * 83 | *-21 | 908 | * 92 | No crack |
| | X8 | *X8 | 950 | 1044 | * 65 | *-23 | 915 | 180 | No crack |
| | X9 | *X9 | 971 | 1068 | * 51 | *-20 | 920 | * 71 | *Crack |
| | X10 | *X10 | 798 | *823 | 151 | -42 | 902 | * 70 | No crack |
| | X11 | *X11 | 1003 | 1115 | * 37 | *-18 | 944 | * 82 | *Crack |
| | X12 | *X12 | 731 | *813 | 156 | -54 | 900 | 189 | No crack |
| | Y1 | 1 | 586 | *724 | * 44 | *-16 | 924 | 216 | No crack |
| | Y2 | 3 | 876 | 958 | * 21 | *-18 | 941 | 224 | No crack |
| | Y6 | 6 | 576 | *738 | * 46 | *-22 | 977 | 196 | No crack |
| | Y10 | 10 | 682 | *796 | *112 | *-24 | 954 | 201 | No crack |

Mark * attached steel No. indicates it is out of the range and one attached to a test result shows it does not attain the aimed level.

HIGH-TOUGHNESS, HIGH-TENSILE-STRENGTH STEEL AND METHOD OF MANUFACTURING THE SAME

TECHNICAL FIELD

The present invention relates to high-tensile-strength steel used in line pipes for conveyance of natural gas and crude oil and in various pressure vessels and the like, and particularly to high-tensile-strength steel having excellent arrestability to brittle fracture propagation, excellent properties at a welded joint and a tensile strength (TS) of not less than 900 MPa.

BACKGROUND ART

In pipelines for long-distance conveyance of natural gas, crude oil, and the like, efforts have focused on improvement of conveyance efficiency through increasing running pressure. In order to enable a pipeline to withstand an increase in running pressure, a conceivable method is to increase the wall thickness of a conventional strength grade steel used for the pipe. However, this method leads to a reduction in efficiency of welding at the work site and a reduction in pipeline construction efficiency due to an increase in structural weight. Therefore, there has been increasing demand for limiting an increase in the wall thickness of the steel pipe through enhancement of the strength of steel products used for the pipe. As one measure to meet this demand, the American Petroleum Institute (API) has recently standardized X80 grade steel, and this steel has been put into practical use. The code "X80" represents a yield strength (YS) of not less than 80 ksi (approximately 551 MPa).

Further, there have been proposed several methods of manufacturing high-strength steel of X100 or X120 grade based on the technique of manufacturing X80 grade steel. Specifically, there have been proposed X100 through X120 grade steel whose strength is attained by making use of Cu precipitation hardening and a method of manufacturing the same (Japanese Patent Application Laid-Open (kokai) Nos. 8-104922, 8-209287, and 8-209288), as well as steel having an increase Mn content and a method of manufacturing the same (Japanese Patent Application Laid-Open (kokai) Nos. 8-209290 and 8-209291).

The former steel products manufactured through utilization of precipitation hardening surely have excellent field weldability and high base metal strength since hardness decreases at the heat affected zone of a welded joint. However, due to Cu precipitates dispersed within matrix, the arrestability of brittle fracture propagation (hereinafter referred to as "arrestability") is not sufficiently imparted. The arrestability is a property required of steel products in order to prevent a disastrous incident in which a welded steel structure would suddenly collapse due to brittle fracture.

Generally, the design of a welded steel structure takes account of the presence of defects of a certain degree in welded joints. Even when a brittle crack initiates from a defect present in a welded joint, if the base metal can arrest the propagation of the brittle crack, a disastrous incident could be prevented. Accordingly, for an large welded steel structure, welded joints must have a required anti-crack-initiation property (hereinafter referred to as "initiation property"), and the base metal must have required arrestability. Of course, in some cases, initiation property must be required for the base metal. Initiation property and arrestability are neither independent of nor unrelated to each other. For example, in the case in which hardening is induced by coherent precipitation of precipitates, both properties are impaired. Another factor—for example, refinement of microstructure—induces a great effect of improving initiation property, but merely a small (not zero) effect of improving arrestability. In discussing these two properties, it must be noted that a certain impact test provides a test result reflecting the two properties. The Charpy impact test provides a test result reflecting these two properties, but is said to reflect initiation property to a greater extent. In order to obtain a test result reflecting only arrestability, there must be employed DWTT or a double tension test, which will be described later in the EXAMPLES section, or a like test. Such tests use a relatively large test piece in which a portion where a brittle crack initiates and a portion where a brittle crack is arrested are separate from each other. Historically, these two properties have not been differentiated from each other, and a property obtained by the Charpy impact test or the like has been referred to as "toughness." Even at present, normally, so-called toughness includes arrestability and initiation property. Herein, unless otherwise specified, toughness refers to both arrestability and initiation property.

High-Mn-content steel disclosed in Japanese Patent Application Laid-Open (kokai) No. 8-209290 can assume required hardenability through containment of a large amount of Mn, which are relatively inexpensive, thereby reducing the use of Ni and Mo, which are expensive alloy elements. However, when the manganese content is increased and the nickel content is decreased, a welded joint will fail to assume the required initiation property, and the base metal will fail to assume required arrestability. A steel product which, as a base metal, has relatively low arrestability is not applicable to an important welded steel structure, and thus applications thereof are limited.

"Properties of welded joint" includes the toughness, particularly both "initiation property" and "strength," of a welded joint. A "welded joint" normally refers to both heat affected zone (including so-called "bond"; hereinafter abbreviated as HAZ) and weld metal. However, hereinafter, unless otherwise specified, a weld joint refers only to HAZ.

The above-mentioned line pipes are planned to be applied to high-pressure operation in the near future. In preparation for such applications, there has been demand for X120 grade steel products having required arrestability. X120 grade steel must have a YS of not less than 850 MPa. In this case, the TS of such steel becomes 900 MPa or higher. Steel products for line pipe use having such a high strength grade and sufficient arrestability have not yet been put into practical use.

DISCLOSURE OF THE INVENTION

An object of the present invention is to provide high-tensile-strength steel having excellent arrestability, excellent initiation property at a joint when welded, and a TS of not less than 900 MPa, as well as a method of manufacturing the same. Specific target performance will be described below. Test items and the nature of the tests, particularly DWTT (Drop Weight Tear Test) for evaluating arrestability, will be described in the EXAMPLES section.

1. Performance of Base Metal

TS: Not less than 900 MPa (there is no particular upper limit of TS, but approximately 1050 MPa may be used as a standard upper limit).

Arrestability: 85% FATT (Fibrous Appearance Transition Temperature) as measured at DWTT is not higher than −30° C.

Initiation property: vE-40(absorbed energy at −40° C.)≧150J as measured at the 2 mm-Vnotch Charpy impact test 2. Welding Performance TS of welded joint: Not less than 900 MPa Initiation property: vE-20≧150J as measured at the 2 mm-Vnotch Charpy impact test conducted on HAZ Field weldability: Temperature for prevention of cracking as measured at the y-groove restraint cracking test is not higher than room temperature.

In an attempt to obtain high-tensile-strength steel having a TS of not less than 900 MPa, excellent arrestability, and excellent properties of a joint when welded at a relatively large heat input (3 to 10 kJ/mm), the inventors of the present invention have studied various kinds of steel having different compositions and microstructures and have confirmed the following.

a) With bearing Ni in an amount in excess of 1.2 wt. %, even high-tensile-strength steel having a TS of not less than 900 MPa can assume excellent arrestability and excellent toughness of HAZ.

b) Chemical composition must be subjected to the following limitations.

As far as steel products having a relatively small thickness are concerned, the upper limit of carbon equivalent is set according to the presence or the absence of B in order to avoid excessive hardening, i.e. an excessive volume percentage of martensite, such as 100% martensite. Also, the lower limit of carbon equivalent is set according to the presence or absence of B in order to assume required strength.

c) In order to improve the arrestability of base metal, it is desirable to employ the mixed structure of lower bainite and martensite which are mixed at an appropriate ratio. Further, in order to refine the mixed structure, dislocation density accumulated through working should be high enough so that the nucleation density of lower bainite increases. Thus, the aspect ratio of prior austenite grains (hereinafter, "austenite" may be written as "γ"), which have good correspondence with dislocation density, is set to not less than 3.

The gist of the present invention is completed based on the above findings and tests conducted on the site of production, and is to provide the following high-tensile-strength steel and the following method of manufacturing the same.

(1) A high-tensile-strength steel having a tensile strength of not less than 900 MPa and including the following alloy element % by weight: C: 0.02% to 0.1%; Si: not greater than 0.6%; Mn: 0.2% to 2.5%; Ni: greater than 1.2% but not greater than 2.5%; Nb: 0.01% to 0.1%; Ti: 0.005% to 0.03%; N: 0.001% to 0.006%; Al: not greater than 0.1%; Cu: 0% to 0.6%; Cr: 0% to 0.8%; Mo: 0% to 0.6%; V: 0% to 0.1%; and Ca: 0% to 0.006%; with condition (a) or (b) below being satisfied, and P and S among unavoidable impurities being contained in an amount of not greater than 0.015% and not greater than 0.003%, respectively:

(a): B being contained in an amount of 0% to 0.0004%, and the carbon equivalent value Ceq as defined by equation 1) below being 0.53% to 0.7%; and (b): B being contained in an amount of greater than 0.0004% but not greater than 0.0025%, and the carbon equivalent value Ceq as defined by equation 1) below being 0.4% to 0.58%:

$$Ceq=C+(Mn/6)+\{(Cu+Ni)/15\}+\{(Cr+Mo+V)/5\} \quad 1):$$

wherein each atomic symbol represents the content (wt. %) of the corresponding element.

(2) A high-tensile-strength steel as described above in (1), Mn being contained in an amount of not less than 0.2% by weight but less than 1.7% by weight, and condition (a) being satisfied.

(3) A high-tensile-strength steel as described above in (2), wherein the microstructure satisfies the following condition (c):

(c): a mixed structure of martensite and lower bainite occupying at least 90 vol. % in the microstructure; lower bainite occupying at least 2% in the mixed structure; and the aspect ratio of prior γ grains being not less than 3.

(4) A high-tensile-strength steel as described above in (1), Mn having an amount of not less than 0.2% by weight but less than 1.7% by weight, and condition (b) being satisfied.

(5) A high-tensile-strength steel as described above in (4), wherein the microstructure satisfies condition (c) described above.

(6) A high-tensile-strength steel as described above in (1), Mn having an amount of 1.7% by weight to 2.5% by weight, and condition (a) being satisfied.

(7) A high-tensile-strength steel as described above in (6), wherein the microstructure satisfies condition (c) described above.

(8) A high-tensile-strength steel as described above in (1), Mn having an amount of 1.7% by weight to 2.5% by weight, and condition (b) being satisfied.

(9) A high-tensile-strength steel as described above in (8), wherein the microstructure satisfies condition (c) described above.

(10) A high-tensile-strength steel as described above in (1),(2),(4),(6), or (8), wherein the value of Vs as defined by equation 2) below being 0.10% to 0.42%.

$$Vs=C+(Mn/5)+5P-(Ni/10)-(Mo/15)+(Cu/10) \quad 2):$$

wherein each atomic symbol represents its content(wt %).

(11) A high-tensile-strength steel as described above in (3), (5), (7), or (9), wherein the value of Vs as defined by equation 2) being 0.10% to 0.42%.

(12) A method of manufacturing a high-tensile-strength steel as described above in (3), (5), (7), (9) or (11), comprising the steps of: heating a steel slab to a temperature of 1000° C. to 1250° C.; rolling the steel slab into a steel plate such that the accumulated reduction ratio in γ the non-recrystallization temperature zone becomes not less than 50%; terminating the rolling at a temperature above the $Ar_3$ point; and cooling the steel plate from the temperature above the $Ar_3$ point to a temperature of not greater than 500° C. at a cooling rate of 10° C./sec to 45° C./sec as measured at the center in the thicknesswise direction of the steel plate.

(13) A method of manufacturing a high-tensile-strength steel as described above in (12), further including a step of tempering at a temperature of not higher than the $Ac_1$ point.

The above-described high-tensile-strength steels refer primarily to steel plates, but are not limited thereto and may refer to hot rolled steels or bar steels. Also, the above-described high-tensile-strength steels encompass not only steels which contain alloy elements in the above-described ranges of content but also steels which contain, in addition to the alloy elements, known as trace elements which causes no significant change in steel performance.

The average state of the microstructure must satisfy condition (C) at the surface layer, at ¼ of plate thickness, and at ½ of plate thickness.

Residual phases other than the mixed structure of martensite and lower bainite are residual γ, upper bainite, and other minor phases. When residual γ is contained in the microstructure, its profile obtained by X-ray diffraction can be analyzed for quantification. However, the volume percentage of residual γ is usually negligible.

In order to measure the volume percentage of the mixed structure of martensite and lower bainite, a thin specimen is observed through transmitting electron microscopy, or an extracted replica is observed through an electron microscope. Particularly, an extracted replica is useful because it enables clear identification of difference in the precipitation form of carbides (cementite) within martensite or lower bainite. Further, an extracted replica enables observation not only of a local area but also over a relatively wide area.

In order to measure an average percentage of the mixed structure of martensite and lower bainite in relation to the entire microstructure through use of an extracted replica, it is desirable to average percentage values obtained from 10 to 30 fields of view observed at approximately 2000 magnification. The observation through transimitting electron microscopy of a thin specimen enables accurate measurement, but requires higher magnification. Accordingly, the coverage of a single field of view becomes narrower. Thus, in the observation of transmitting electron microscopy, it is preferable for 50 to 100 fields of view to be observed in order to obtain the correct average percentage.

A prior γ grain boundary refers to the grain boundary of non-crystallized γ grains in which transformation to the aforementioned mixed structure occurs immediately. When the mixed structure is generated as a main phase (unless pro-eutectoid ferrite is generated), the prior γ grain boundary is clearly identified even after the transformation. The aspect ratio of the prior γ grain boundary is also represented in the form of an average value. The aspect ratio refers to a value obtained by dividing the length (major diameter) of a prior γ grain as measured in the rolling direction by the width (minor diameter) of a prior γ grain as measured in the direction of plate thickness.

The "non-recrystallization temperature zone" refers to a temperature zone in which crystals deformed by rolling do not clearly recrystallize. For an Nb-containing steel having a TS of not less than 900 MPa according to the present invention, the non-recrystallization temperature zone is a temperature zone of not higher than 950° C. Accordingly, the "accumulated reduction ratio at the non-recrystallization temperature zone" refers to a value obtained by dividing the quantity (plate thickness at 950° C.—finished plate thickness) by plate thickness at 950° C.

BRIEF DESCRIPTION OF DRAWINGS

FIG. 1 is a table showing part (major elements) of the chemical composition of high-tensile-strength steel used in EXAMPLES.

FIG. 2 is a table showing part (optional elements) of the chemical composition of the high-tensile-strength steel used in EXAMPLES.

FIG. 3 is a table showing a method of manufacturing the high-tensile-strength steel used in EXAMPLES.

FIG. 4 is a view showing the microstructure of the high-tensile-strength steel used in EXAMPLES.

FIG. 5 is a table showing the test result of the high-tensile-strength steel used in EXAMPLES.

BEST MODE FOR CARRYING OUT THE INVENTION

The reason for the above-described limitations employed in the present invention will now be described. In the following description, high-tensile-strength steel is assumed to be a steel plate or hot rolled steel coil.

1. Alloy Elements

"%" indicative of the content of an alloy element refers to "wt. %."

C: 0.02% to 0.1%

C is effective for increasing strength. In order for the steel of the present invention to have a TS of not less than 900 MPa, the carbon content must be not less than 0.02%. However, if the carbon content is in excess of 0.1%, not only are the arrestability of the base metal and initiation property impaired, but also field weldability is significantly impaired. Therefore, the upper limit of the carbon content is determined to be 0.1%. In order to further improve strength and arrestability, the carbon content is preferably 0.04% to 0.085%.

Si: not greater than 0.6%

Si has a high deoxidization effect. If the silicon content is 0, the loss of Al during deoxidization increases. Accordingly, the lower limit of the silicon content is preferable to be, for example, approximately 0.01%. By contrast, if the silicon content is in excess of 0.6%, not only does the toughness of HAZ decrease, but also formability is impaired. Therefore, the upper limit of the silicon content is determined to be 0.6%. In order to further improve the toughness of HAZ, the silicon content is preferably not greater than 0.3%. When a sufficient TS is assumed through addition of other elements, the silicon content is preferably not greater than 0.1%.

Mn: 0.2% to 2.5%

Mn is effective for increasing strength and thus is added in an amount of not less than 0.2% so as to assume a required strength. However, if the manganese content is in excess of 2.5%, the arrestability of the base metal and the initiation property of HAZ are impaired. Accordingly, for high-tensile-strength steel having a TS of not less than 900 MPa, the manganese content is limited to not greater than 2.5%. Also, excess Mn accelerates center segregation during solidification in the process of casting. Particularly, for high-tensile-strength steel according to the present invention, excess Mn induces weld cracking and defects caused by hydrogen. Therefore, addition of Mn in an amount in excess of 2.5% must be avoided.

Also, when the manganese content is limited to less than 1.7%, center segregation is significantly reduced. Accordingly, for application to an environment in which hydrogen-induced cracking along a center segregation portion is likely to happen, Mn is contained in an amount of less than 1.7%. For steel to be applied to line pipes, a manganese content of less than 1.7% is rather commonly employed. For application to other structures, a manganese content of 1.7% to 2.5% is advantageous in economical terms.

Ni: greater than 1.2% but not greater than 2.5%

Ni is effective for increasing strength and for improving toughness, particularly arrestability. Also, Ni is particularly significantly effective for improving the toughness of HAZ through control of the form of precipitation of carbides in HAZ. Accordingly, the nickel content must be in excess of 1.2%. However, if the nickel content is in excess of 2.5%, hardening is overdone for the plate thickness range of line pipes; consequently, no lower bainite is generated. Therefore, the effect of dividing the γ grain by lower bainite is not obtained, which leads to the lack in the improvement of base metal toughness. Therefore, the nickel content is determined to be not greater than 2.5%.

Nb: 0.01% to 0.1%

Nb is effective for refining γ grains during thermomechanical treatment and is thus contained in an amount of not less than 0.01%. However, if the niobium content is in excess of 0.1%, not only is the toughness of HAZ impaired, but also field weldability is significantly impaired. Therefore, the upper limit of the niobium content is determined to be 0.1%. In order to refine the microstructure of the base metal and improve the toughness of HAZ, the niobium content is preferably 0.02% to 0.05%.

Ti: 0.005% to 0.03%

Ti is effective for hindering the growth of γ grains during heating of a slab and is thus contained in an amount of not less than 0.005%. Particularly, for Nb-containing steel, Ti is effectively contained in a trace amount of not less than 0.005% so as to restrain the formation of cracks in the surface of a continuously cast slab which would otherwise be accelerated by addition of Nb. On the contrary, if the titanium content is in excess of 0.03%, TiN becomes coarse, thereby canceling the γ grains refinement effect. Therefore, the titanium content is determined to be not greater than 0.03%.

N: 0.001% to 0.006%

N is bound to Ti to produce TiN, thereby restraining the growth of y grains during slab reheating and welding. To obtain such an effect, the lower limit of the nitrogen content is determined to be 0.001%. On the contrary, an increase in N causes impairment of slab quality and impairment of the toughens of HAZ due to an increase in solid-solution N. Therefore, the upper limit of the nitrogen content is determined to be 0.006%.

Al: not greater than 0.1%

Al is normally added to molten steel as a deoxidizer. Except for Al in the oxide form, Al is contained in solidified steel in the form of solAl such as Al in solid-solution and AlN. AlN acts effectively in refinement of the microstructure. Thus, in order to improve base metal toughness, Al is preferably contained in an amount of not less than 0.005%. However, since excess Al causes the coarsening of inclusions such as oxides and thus impairs cleanliness of steel and also impairs the toughness of HAZ, the upper limit of the aluminum content is determined to be 0.1%. In order to obtain favorable initiation property of HAZ, the upper limit is preferably 0.06%, more preferably 0.05%.

Cu: 0% to 0.6%

Cu may not be contained. However, since Cu is effective for increasing strength, Cu is added for steel whose carbon content is rendered lower for use in an environment where weld cracking is likely to occur and yet which must have required strength. If the copper content is less than 0.2%, the effect of increasing strength is weak. Accordingly, when Cu is to be added, the copper content is preferably not less than 0.2%. By contrast, if the copper content is in excess of 0.6%, toughness is impaired. Therefore, the upper limit of the copper content is determined to be 0.6%. Further, for improvement of toughness, the copper content is preferably not greater than 0.4%.

Cr: 0% to 0.8%

Cr may not be contained. However, since Cr is effective for increasing strength, Cr is added when the carbon content must be decreased for improvement of strength. If the chromium content is less than 0.15%, the effect is not sufficiently exhibited. Accordingly, when Cr is to be added, the chromium content is preferably not less than 0.15%. On the contrary, if the chromium content is in excess of 0.8%, toughness is impaired. Therefore, the upper limit of the chromium content is determined to be 0.8%. For further balanced improvement of toughness and strength, the chromium content is preferably 0.3% to 0.7%.

Mo: 0% to 0.6%

Mo may not be contained. However, since Mo is effective for increasing strength, Mo is added when the carbon content is decreased. If the molybdenum content is less than 0.1%, the effect is weak. Accordingly, when Mo is to be added, the molybdenum content is preferably not less than 0.1%. On the contrary, if the molybdenum content is in excess of 0.6%, toughness is impaired. Therefore, the upper limit of the molybdenum content is determined to be 0.6%. For attainment of strength and toughness falling within more favorable ranges, the molybdenum content preferably ranges from 0.3% to 0.5%.

V: 0% to 0.1%

V may not be contained. However, since V, if added, increases strength without significant enhancement of hardenability, V is added when required strength is to be attained without enhancement of hardenability. If the vanadium content is less than 0.01%, the effect is weak. Accordingly, when V is to be added, the vanadium content is preferably not less than 0.01%. On the contrary, if the vanadium content is in excess of 0.1%, toughness is impaired. Therefore, the upper limit of the vanadium content is determined to be 0.1%. For attainment of favorable-toughness and strength, the vanadium content is preferably 0.01% to 0.06%.

Ca: 0% to 0.006%

Ca may not be contained. However, Ca, if added, together with Mn, S, O, or the like, forms sulfates or oxides to thereby refine grains of HAZ. Hence, Ca is preferably added particularly when the initiation property of a welded joint is to be improved. If the calcium content is less than 0.001%, the effect is weak. Accordingly, when Ca is to be added, the calcium content is preferably not less than 0.001%. On the contrary, if the calcium content is in excess of 0.006%, non-metallic inclusions in steel increase, causing inner defects. Therefore, the calcium content is determined to be not greater than 0.006%.

B and Ceq (hardenability):

In the portion of steel ranging from the surface layer portion to the center portion in the thickness direction, in order for the microstructure to satisfy condition (c), hardenability must be adjusted. The effect of C, Mn, Cu, Ni, Cr, Mo, and V on hardenability is evaluated by means of carbon equivalent Ceq, in which the contents of the elements are incorporated. In the present invention, the boron content is not incorporated in Ceq. However, since even a trace amount of B contributes to the improvement of hardenability, the addition of B would be considered. Among other elements, Nb in the solid solution state improves hardenability. However, when steel is manufactured through thermomechanical treatment, Nb (CN) precipitates during hot rolling; thus, the density of solid-solution Nb does not vary significantly at a niobium content ranging from 0.01% to 0.1%. All steels of the present invention contain Nb in an amount of the range. Thus, it is not necessary for the present invention to consider Nb as a factor of variation of hardenability. This also applies to Si because the contribution of Si to the improvement of hardenability is small.

If the boron content is not greater than 0.0004%, the effect of improving hardenability is not exhibited. Accordingly, when the hardenability should be increased by the addition of B, the boron content must be in excess of 0.0004%. On the contrary, if the boron content is in excess of 0.0025%, the toughness of HAZ is significantly impaired. Therefore, the upper limit of the boron content is determined to be 0.0025%. For attainment of sufficient toughness and hardenability of HAZ, the boron content is preferably 0.0005% to 0.002%. When the boron content is greater than 0.0004% but not greater than 0.0025%, the carbon equivalent value should be lowered than that of steel in which the effect of B is not produced (referred to as "B-free steel" whose boron content ranges from 0% to 0.0004%), thereby avoiding excessively hardened microstructure which would otherwise occur due to intensified hardenability. That is, the value of carbon equivalent Ceq is determined to range from 0.4% to 0.58%. If the Ceq value is less than 0.4%, even when the effect of improving hardenability is sufficiently obtained through addition of B, a TS of 900 MPa is difficult to attain. Thus, the Ceq value is determined to be not less than 0.4%. On the contrary, if the Ceq value is in excess of 0.58%, hardenability is excessively enhanced together with the effect of B, and accordingly toughness is impaired. Therefore, the Ceq value is determined to be not greater than 0.58%. The above-described conditions concerning B and Ceq correspond to condition (b) in invention (1).

B does not have the effect of enhancement of hardenability on HAZ. Thus, hardening is restricted by a degree corresponding to a reduction of the Ceq value, whereby the sensitivity of weld cracking of B bearing steel is lowered. However, B tends to increase the average lengths of martensite and lower bainite in their growing directions and thus to decrease toughness. Thus, when some increase in the sensitivity of weld cracking is acceptable and excellent toughness is to be attained, B-free steel should be adopted. That is, a boron content of 0% to 0.0004% is used. For B-free steel, a Ceq value of 0.53% to 0.7% is used in order to obtain required hardenability of base metal. If the Ceq value is less than 0.53%, hardenability becomes insufficient, resulting in a failure to obtain a TS of not less than 900 MPa. On the contrary, if the Ceq value is in excess of 0.7%, hardening is overdone, resulting in an impairment of arrestability. Therefore, the upper limit of the Ceq value is determined to be 0.7%. These conditions concerning B and Ceq correspond to condition (a) in invention (1).

Vs: 0.10% to 0.42%

In the present invention, in addition to limitations on individual alloy elements are described above, the value of index Vs is also limited in order to improve center segregation. If the Vs value is in excess of 0.42%, center segregation significantly occurs in a continuously cast slab. Thus, when high-tensile-strength steel having a TS of not less than 900 MPa is manufactured by the continuous casting process, the central portion thereof suffers an impairment in toughness. On the contrary, if the Vs value is limited to less than 0.10%, the degree of center segregation is small, but a TS of 900 Mpa cannot be attained. Therefore, the lower limit of thelower of the Vs value is determined to be 0.10%.

P: not greater than 0.015%

S: not greater than 0.003%

Among unavoidable impurity elements, P and S have a significant effect on toughness. Thus, the phosphorus and sulfur contents must be decreased. By decreasing the phosphorus content, center segregation in a slab is reduced, and brittle fracture which would otherwise be derived from brittle grain boundary is restrained. S precipitates in steel in the form of MnS, which is elongated by rolling thereby have an adverse effect on toughness. Thus, in order to restrain these adverse effects, a phosphorus content should be greater than 0.015%, and a sulfur content should not be greater than 0.003%. The contents of other unavoidable impurities should be preferably lower. However, an excessive attempt to decrease their contents causes cost increase. Thus, such unavoidable impurities may be contained within ordinary ranges of content.

Other elements:

In addition to the above-described elements, rare earth elements (La, Ce, Y, Nd, etc.), Zr, W, and the like may be contained in trace amounts.

2. Microstructure

By subjecting steel having the above-described chemical composition to regular thermomechanical treatment or heat treatment, high-tensile-strength steel having target performance and a TS of not less than 900 MPa is obtained. Also, high-tensile-strength steel having more improved performance is obtained through conformity to not only the limitations on chemical composition but also condition (c) concerning microstructure.

2-1) Mixed Structure of Martensite and Lower Bainite

In order to impart more excellent strength and toughness to the base metal, the microstructure assumes the "mixed structure of martensite and lower bainite (hereinafter referred to as the "mixed structure"). The mixed structure is adapted to have a volume percentage of not less than 90%. Herein, "lower bainite" refers to a microstructure in which fine cementite is dispersedly precipitated within lath-like bainitic ferrite while forming an angle of 60 degrees with the end surface of the lath-like bainitic ferrite (the surface of a tip end portion of lath-like bainitic ferrite, which grows within γ while sustaining a constant angle). There is only one crystal lattice plane for fine cementite precipitaion within a single bainitic ferrite. Tempered martensite also has a microstructure in which cementite precipitates within martensite lath, but is different from lower bainite in that four variants of crystal lattice plane for cementite precipitation are present.

The mixed structure is required to have a volume percentage of not less than 90%, so as to obtain a target arrestability, i.e. an 85% FATT, of not higher than −30° C. as measured at DWTT. The reason why the mixed structure has excellent toughness is the following. Lower bainite, which is generated prior to the generation of martensite in the high-temperature region during quenching, forms a "wall" to refine γ grains to thereby restrain the growth of a packet (which coincides with the fracture surface unit of brittle fracture) of martensite.

In low-carbon steel encompassed by the present invention, a brittle fracture surface is composed of a cleavage-fracture-surface accompanying no plastic deformation and a plastically deformed ductile-fracture-surface that thinly surrounds said cleavage-fracture-surface. This type of brittle fracture surface is called a pseudo-cleavage fracture surface. While the surrounding ductile-fracture-surface is considered as a boundary of a cleavage-fracture-surface, the average size of a bounded region is defined as "fracture surface unit." As the fracture surface unit decreases, initiation property and arrestability improve.

If the volume percentage of lower bainite becomes less than 2% in the mixed structure, the above-mentioned effect of dividing the microstructure through the formation of lower bainaite is not produced. Accordingly, the refinement of the microstructure effected by the formation of the mixed structure becomes insufficient, and thus toughness decreases. Accordingly, the volume percentage of lower bainite is determined to be not less than 2%. On the contrary, if the percentage of lower bainite, whose strength is lower than that of martensite, increases excessively, the average strength of steel decreases. Thus, in order to obtain a TS of not less than 900 MPa, the volume percentage of lower bainite in the mixed structure is preferably not greater than 75%. 2—2) Aspect ratio of prior γ grains In order to improve furthermore the toughness of the mixed structure which satisfies the required strength, lower bainite is preferably dispersed in the mixed structure. To achieve such structure, γ should be transformed from the non-recrystallized state, i.e. the state of γ in which dislocations accumulated through reduction are present at high density. In this state, sites of nucleation for lower bainite are present at high density. Accordingly, lower bainite can be generated from a number of nucleation sites present on γ grain boundaries and within γ grains. In order to reliably produce the effect, the aspect ratio (flatness) of non-recrystallized γ (prior γ grains) must be at least 3.

3. Manufacturing Method

A method of manufacturing steel of the present invention will next be described in detail. The manufacturing method (12) is to incorporate the microstructure satisfying condition (c) into steel (2), (4), (6), (8) or (10) and obtain steel (3), (5), (7) (9), or (11) respectively.

The most important aspect of the manufacturing method is that lower bainite and martensite are generated through nucleation not only on prior γ grain boundaries but also within γ grains where high density of dislocations have been accumulated during hot rolling.

(a) Hot rolling

The heating temperature for a steel slab is not higher than 1250° C. in order to prevent the coarsening of γ grains during heating. Also, the heating temperature is not lower than 1000° C. in order to obtain Nb in-solid-solution which is effective for restricting the recrystallization and refining grains during rolling and for precipitation hardening after rolling. In order to generate lower bainite through nucleation within γ grains and to suppress the growth of lower bainite, dislocations must be present at high density. To achieve high dislocation density, rolling must be performed at a reduction ratio of not less than 50% in the non-recrystallization temperature zone of γ. On the contrary, if the reduction ratio is in excess of 90% in the non-recrystallization temperature zone of γ, mechanical properties become significantly anisotropic. Accordingly, the reduction ratio is preferably not greater than 90% in the non-recrystallization temperature zone.

If the finishing temperature of rolling is lower than the $Ar_3$ point, an intensive degree of deformed texture develops, causing mechanical properties to become anisotropic. Thus, the finishing temperature of rolling is determined to be not lower than the $Ar_3$ point.

(b) Cooling

In order to restrain the generation of upper bainite which would impair toughness, rolled steel must be cooled from a temperature of not lower than the $Ar_3$ point at a constant cooling rate. The cooling rate performed after rolling is a factor for obtaining appropriate distribution percentage among various structures. The cooling rate is 10° C./s to 45° C./s as measured at a thickness center portion for steel plates and at a wall-thickness center portion for general steel products. If the cooling rate is less than 10° C./s, upper bainite is generated, or the percentage of lower bainite exceeds 75%, whereby strength and toughness, particularly arrestability, are impaired. On the contrary, if the cooling rate is in excess of 45° C./s, lower bainite is not generated, and thus the microstructure is of martensite only, whereby toughness, particularly arrestability, is impaired.

A temperature at which cooling ends is not higher than 500° C. If the temperature is higher than 500° C., upper bainite is generated, and thus the mixed structure which satisfies the aforementioned condition (c) is not obtained. Rolled steel may be cooled to room temperature. However, when hydrogen density is high in the steel-making stage and thus defects caused by hydrogen are highly likely to occur, preferably, rolled steel is cooled to approximately 200° C. and then cooled slowly for dehydrogenation. Alternatively preferably, rolled steel is cooled to approximately 200° C. and placed in a dehydrogenating annealing furnace while being sustained at a temperature not lower than 200° C., or subjected to tempering, which will be described later. This is because, in most cases, in a process of cooling after rolling, defects caused by hydrogen occur at a temperature lower than 200° C.

(c) Tempering

Steel manufactured by the above-described method may be used as-cooled or may be thereafter tempered at a temperature not higher than the $Ac_1$ point when quite high arrestability is required.

EXAMPLES

The present invention will next be described by way of example.

FIGS. 1 and 2 show the chemical composition of the tested steel. The tested steel was manufactured in the following manner. Steel having the chemical composition of FIGS. 1 and 2 was manufactured in a molten form by an ordinary method. The molten steel was cast to obtain a steel slab. The thus-obtained steel slab was thermomechanically treated under various conditions shown below to thereby obtain steel plates having a thickness of 12 to 35 mm.

FIG. 3 is a table showing conditions of the thermomechanical treatment (hot rolling, cooling, and tempering). As mentioned previously, the non-recrystallization temperature zone of the above steel is not higher than 950° C. Also, the $Ar_3$ point falls within the range of 500° C. to 600° C.

FIG. 4 shows the microstructure of the thicknesswise center portion of the steel plate manufactured under the above-mentioned conditions.

Test pieces were obtained from the thicknesswise center portions of the steel plates and subjected to the following tests. For evaluation of base metal strength, a tensile test (test piece: No. 4 of JIS Z 2204; test method: JIS Z 2241) was conducted to obtain YS and TS. For evaluation of base metal toughness, the Charpy impact test employing a 2 mm V-notch (test piece: No. 4 of JIS Z 2202; test method: JIS Z 2242) and DWTT were conducted.

DWTT is a test for evaluation of arrestability known generally in the line pipe industry. A press notch is formed in a test piece having an original plate thickness through use of a knife edge. An impact load is applied to the test piece by means of a drop weight or a large-sized hammer to thereby initiate a brittle crack from the notch. After the test piece is fractured, the fracture appearance is observed. Arrestability is evaluated merely based on a temperate at which a transition from ductile fracture appearance to brittle fracture appearance occurs. In a valid test, brittle fracture appearance is initiated from the bottom of a press notch, and subsequently, the brittle fracture appearance changes to ductile fracture appearance (the propagation of a ductile crack requires a large amount of energy). When ductile fracture appearance accounts for not less than 85% of the entire fracture appearance (85% FATT), arrestability is judged sufficient at the test temperature. If a brittle crack is not initiated from the bottom of the notch, the test is invalid. In such a case, the bottom of the notch is subjected to carburization or the like to thereby further embrittle the notch bottom so that a brittle crack is initiated from the notch bottom. In the present example, brittle fracture appearance was initiated from the bottom of a press notch for all tested specimens.

The Charpy impact test employing a 2 mm V-notch is primarily intended to evaluate initiation property, but is also considered as a toughness evaluation test into which arrestability is partially incorporated. In the 2 mm V-notch Charpy impact test conducted on the base metal, absorbed energy at a test temperature of −40° C. was obtained.

A toughness test on welded joints was conducted in the following manner. Test pieces were subjected to a welding-heat cycle reproduction test machine under the following conditions: maximum heating temperature: 1350° C.; cooling from 800° C. to 500° C. at a cooling rate equivalent to a heat input of 40,000 J/cm. From the thus-treated test pieces, 2 mm V-notch Charpy impact test pieces were obtained and subjected to the 2 mm V-not Charpy impact test at −20° C. to thereby primarily evaluate initiation property, as mentioned above.

Field weldability was evaluated by the y-groove restraint cracking test (JIS Z 3158). Weld cracking properties are almost determined by chemical composition and are not influenced by the microstructure of base metal. Thus, test pieces were manufactured in the following manner. Steel plates having a thickness of 25 mm were manufactured from steel having the chemical composition shown in FIGS. 1 and 2 at a heating temperature of 1150° C. and a finishing temperature of 900° C. From the thus-manufactured steel plates, y-groove restraint cracking test pieces with the original plate thickness were obtained. As a welding material, a commercially available manual welding rod for use in welding 100 ksi high-tensile-strength steel was used. The test pieces were laid in the atmosphere having a temperature of 20° C. and a humidity of 75% for 2 hours so as to obtain a hydrogen density of approximately 1.5 cc/100 g. Then, a weld bead was laid at an heat input of 1.7 kJ/mm, followed by cooling to room temperature. Subsequently, the welded test pieces were examined for cracking in accordance with JIS Z 3158.

FIG. 5 is a table showing the test results.

In test Nos. X1 to X10 of the Comparative Example, the alloy element content of each corresponding steel has the following feature: excessive C content (X1); excessive Si content (X2); excessive Mn content (X3); excessive Cu content (X4); excessively small Ni content (X5); excessive Cr content (X6); excessive Mo content (X7); excessive V content (X8); excessive Ti content (X9); and excessive Al content (X10). X1 to X9 showed insufficient toughness, particularly insufficient arrestability, of the base metals. X10 satisfied a target toughness, but failed to provide a strength of 900 MPa.

In the Comparative Example, X11 and X12 have an excessively large Ceq value and an excessively small Ceq value, respectively. In this connection, X11 exhibited low toughness and the formation of weld crack, and X12 exhibited low strength and low toughness due to insufficient hardenability.

In Y1, Y2, Y6, and Y10 of the Comparative Example, the chemical composition of steel conforms to that of the present invention; however, hot rolling or cooling conditions deviate from those of an ordinary method, and the microstructure does not satisfy condition (c). As a result, Y1, Y2, Y6, and Y10 exhibited a significantly unsatisfactory base metal toughness.

On the contrary, in the Example of the present invention, a TS of not less than 900 MPa was obtained. Also, in the Charpy impact test conducted at −40° C., an absorbed energy of not less than 200 J was obtained. In DWTT of the greatest interest, 85% FATT was not higher than −40° C., indicating that arrestability is quite satisfactory. Further, properties of welded joint and field weldability were also favorable.

INDUSTRIAL APPLICABILITY

According to the present invention, there can be obtained high-tensile-strength steel having a tensile strength of not less than 900 MPa and favorable toughness, particularly favorable arrestability. Thus, the present invention enables great improvement in the construction efficiency of pipeline with sufficiently high safety as well as in efficiency of conveyance through pipeline.

What is claimed is:

1. A high-tensile-strength steel with a tensile strength of not less than 900 MPa, consisting essentially of, by weight percent, C: 0.02% to 0.1%;

Si: not greater than 0.6%;

Mn: 0.2% to 2.5%;

Ni: greater than 1.2% but not greater than 2.5%;

Nb: 0.01% to 0.1%;

Ti: 0.005% to 0.03%;

N: 0.001% to 0.006%;

B: 0.0004% to 0.0025%;

Al: not greater than 0.1%;

Cu: 0% to 0.6%;

Cr: 0% to 0.8%;

Mo: 0% to 0.6%;

V: 0% to 0.1%;

Ca: 0% to 0.006%; and balance Fe and incidental impurities;

wherein the condition (a) and (b) below is satisfied, and P and S among unavoidable impurities are contained in an amount of not greater than 0.015% and not greater than 0.003%, respectively:

(a): the carbon equivalent value Ceq defined by equation 1) below being 0.4% to 0.58%:

$$Ceq=C+(Mn/6)+\{(Cu+Ni)/15\}+\{(Cr+Mo+V)/5\} \quad 1):$$

wherein each atomic symbol represents the content (wt. %) of the corresponding element, (b): a mixed structure of martensite and lower bainite occupying at least 90 vol. % in the microstructure; lower bainite occupying at least 2 vol. % in the mixed structure; and the aspect ratio of prior austenite grains being not less than 3.

2. A high-tensile-strength steel according to claim 1, wherein Mn is contained in an amount of not less than 0.2% by weight but less than 1.7% by weights.

3. A high-tensile-strength steel according to claim 1, wherein Mn is contained in an amount of 1.7% by weight to 2.5% by weight.

4. A high-tensile-strength steel according to claim 1, wherein Mn is contained in an amount of 1.7% by weight to 2.5% by weight.

5. A high-tensile-strength steel according to claim 1, wherein the value of Vs defined by equation 2) below is 0.10% to 0.42%;

$$Vs=C+(Mn/5)+5P-(Ni/10)-(Mo/15)+(Cu/10) \quad 2):$$

wherein each atomic symbol represents its content (wt %).

6. A high-tensile-strength steel according to claim 2, wherein the value of Vs defined by equation 2) is 0.10% to 0.42%;

$$Vs=C+(Mn/5)+5P-(Ni/10)-(Mo/15)+(Cu/10) \quad 2):$$

wherein each atomic symbol represents its content (wt %).

7. A method of manufacturing a high-tensile-strength steel according to claim 1, comprising the steps of: heating a steel slab to a temperature of 1000° C. to 1250° C.; rolling the steel slab into a steel plate such that the accumulated reduction ratio in the non-recrystallization temperature zone of γ becomes not less than 50%; terminating the rolling at a temperature above the $Ar_3$ point; and cooling the steel plate from the temperature above the $Ar_3$ point to a temperature of not greater than 500° C. at a cooling rate of 10° C./sec to 45° C./sec as measured at the center in the thickness direction of the steel plate.

8. A method of manufacturing a high-tensile-strength steel according to claim 7, further adding a step of tempering at a temperature of not higher than the $Ac_1$ point.

9. A high-tensile-strength steel according to claim 1, wherein the Cu content is no more than 0.4%.

10. A high-tensile-strength steel according to claim 1, wherein the steel is V-free.

11. A high-tensile-strength steel according to claim 1, wherein the steel is Mo-free.

12. A high-tensile-strength steel according to claim 1, wherein the steel is Cr-free.

13. A high-tensile-strength steel according to claim 1, wherein the steel is Cu-free.

* * * * *